United States Patent [19]

Kolbuch

[11] 3,943,588

[45] Mar. 16, 1976

[54] APPARATUS FOR REMOVING A PLURALITY OF SEPERATE ELEMENTS AND METHODS OF UTILIZING SAME

[76] Inventor: Henry M. Kolbuch, 37290 Susan, Sterling Heights, Mich. 48077

[22] Filed: May 22, 1974

[21] Appl. No.: 472,302

[52] U.S. Cl. ..... 10/162 R

[51] Int. Cl.[2] ..... B21K 27/00; B23G 11/00

[58] Field of Search ..... 10/130 R, 130 WH, 132, 10/162 R, 162 A, 169; 83/160; 198/222; 214/1 BB, 8.5 F, 310

[56] References Cited

UNITED STATES PATENTS

| | | | |
|---|---|---|---|
| 673,360 | 4/1901 | Dequede | 198/222 |
| 1,334,304 | 3/1920 | Hodgdon et al. | 83/160 |
| 1,568,082 | 1/1926 | Mitton | 10/162 R |
| 1,968,840 | 8/1934 | Linn | 10/162 R |

*Primary Examiner*—C. W. Lanham
*Assistant Examiner*—E. M. Combs

[57] ABSTRACT

A device for removing a plurality of separate elements from a loading area comprises an open walled member which effectively "sweeps" the elements from the loading or collecting area. The present invention is efficaciously deployed in any environment where such a "sweeping" effect is desirable. The present invention enjoys particular utility in collecting finished nuts and bolts in automated systems for the manufacture thereof.

8 Claims, 5 Drawing Figures

Fig-1 PRIOR ART
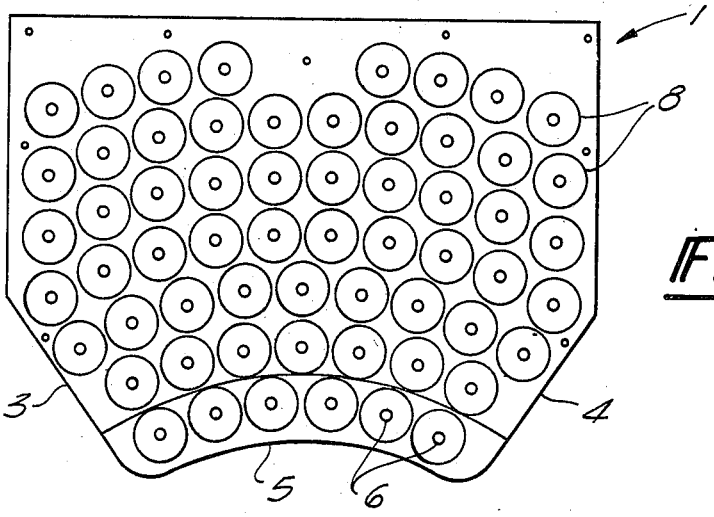
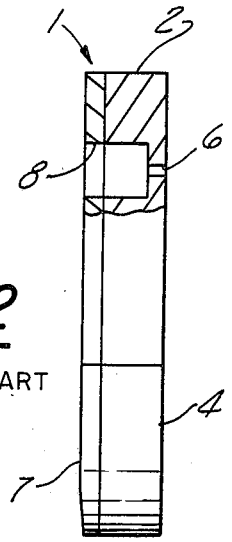
Fig-2 PRIOR ART
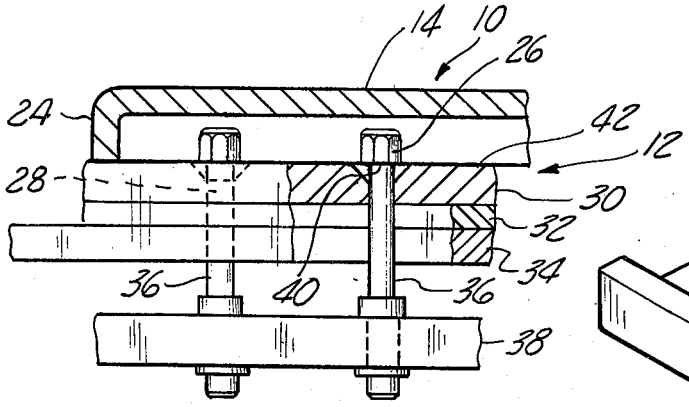
Fig-3
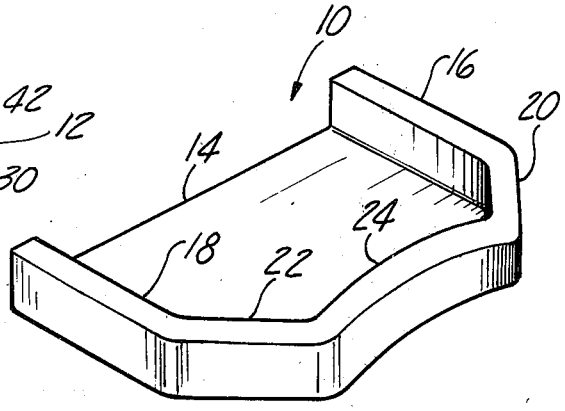
Fig-4
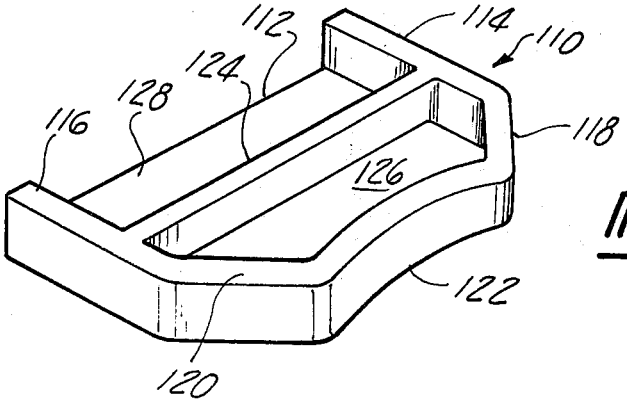
Fig-5

APPARATUS FOR REMOVING A PLURALITY OF SEPERATE ELEMENTS AND METHODS OF UTILIZING SAME

BACKGROUND OF THE INVENTION

1. Field of the Invention

The present invention relates to the removal of separate elements from loading or collection areas therefor. More particularly, the present invention relates to apparatus or a device for removing separate elements from a collection area therefor. Even more particularly, the present invention provides an apparatus for removing separate elements from an automated system for the manufacture of such elements.

2. Prior Art

There has been developed heretofore devices for the removal of separate elements from collection areas therefor in automated systems for the manufacture of such elements. In particular such removal devices have been developed for deployment in automated systems for the manufacture of workpieces, such as, locking elements including nuts and the like.

With particular reference to the manufacture of nuts from nut blanks there has been disclosed in the prior art a fully automated system for such manufacture. Representative of such prior art are the disclosures of U.S. Pat. Nos. 3,727,255 and 3,015,832. This prior art teaches a system for tapping nut blanks wherein, at the completion of the operation, the finished blanks are dropped into a bin.

This is disadvantageous in that this results in complete disorientation of the finished products, thereby requiring a further sorting operation.

To alleviate this problem of sorting, modern day systems now provide for the placement of the finished blanks in suitable trays or similar collecting means therefor. Essentially, these modern day systems contemplate the lifting of the finished blanks into the trays. The trays, per se, are provided with a plurality of sockets each of which receives a finished blank therewithin by being lifted thereinto. It has been found, however, that oftentimes the lifting of the finished blank into the tray is accompanied by the misorientation of the finished nut. This misorientation necessitates the manual removal of a nut from the socket. This necessarily reduces the efficiency of the system while concommitantly increasing labor costs and the like.

The present invention, on the other hand, provides a device for unloading a plurality of separate elements which avoids the problems alluded to hereinbefore.

SUMMARY OF THE INVENTION

In accordance with the present invention there is provided a device for the removal of separable elements, such as, finished nut blanks and the like, from an unloading or collection area. The device hereof generally comprises a substantially planar member having three upstanding walls integrally formed therewith which, thus, cooperate to define an open-walled and open-topped member.

The member is mounted on suitable means for the movement thereof into and out of the collection area. Preferably, the member is mounted on a hydraulic ram for movement into and out of the unloading or collection area.

In an alternate embodiment of the present invention the device is provided with a medially disposed upstanding partition. The partition facilitates the sweeping effect by providing a further sweeping area.

For a more complete understanding of the present invention reference is made to the following detailed description and accompanying drawing. In the drawing like reference characters refer to like parts throughout the several views in which:

BRIEF DESCRIPTION OF THE DRAWING

FIG. 1 is a top plan view of a removal device of the prior art;

FIG. 2 is a side elevational view, partly in cross-section, of the prior art device shown in FIG. 1;

FIG. 3 is a side elevational view, partly in phantom, partly in cross-section, depicting the deployment of the device of the present invention in use with a nut blank tapping operation;

FIG. 4 is a perspective view of the device of the present invention, and

FIG. 5 is a perspective view of an alternate embodiment of the device of the present invention.

DESCRIPTION OF THE PREFERRED EMBODIMENT

In order to faciliate an understanding of the present invention, by way of background, a brief explanation of the prior art will be given with reference to FIGS. 1 and 2. As hereinbefore noted, present day manufacturing of tapped nut blanks generally proceeds in accordance with the teachings of U.S. Pat. Nos. 3,727,255 and 3,015,832, the disclosures of which are hereby incorporated by reference. Furthermore, as noted previously, the teachings in these references of merely dropping the finished nut blank into a bin has now been eliminated. According to current practice, the fingers disclosed in the references lift the finished blanks into a device generally indicated at 1.

The device 1 generally comprises a base plate member 2, having a substantially pentagonal configuration, but wherein the legs 3, 4 thereof, which would merge into an apex, are joined through an arcuate section 5. The plate 2 is provided with a plurality of apertures 6 which function as knock-out means for finished blanks stored in the device. A cover plate 7 is secured to the base plate 6 such as by welding or the like. Through the cover plate 7 and base plate 2 a plurality of sockets 8 are formed substantially concentrically with the apertures 6, as shown.

The device 1 is normally mounted for synchronized movement into and out of an unloading area, whereat the fingers lift the finished blanks into the sockets 8. As noted hereinbefore, one of the major drawbacks associated with the device 1 is the often occurring problem of misalignment of a finished nut blank in a socket 8.

With this background, reference is now made to FIGS. 3 and 4 for a detailed explanation of a first embodiment of the present invention. In accordance with the present invention there is provided a device, generally indicated at 10, for sweeping or raking finished nut blanks from an unloading area, generally indicated at 12.

The device 10 includes a base plate 14 having integrally formed upstanding slide walls 16, 18. Each of the sidewalls 16, 18 is joined to a short wall 20, 22, respectively. The short walls are integrally formed with the base plate and their respective side walls, but, as shown, are angularly disposed with respect to the sidewalls. An arcuate upstanding wall 24 joins the free ends of the short walls. The upstanding walls and base plate, thus, cooperate to define an open-walled, open-topped substantially pentagonal raking or sweeping device.

In deploying the device 10 in nut manufacturing operations, the device is normally mounted on means (not shown) for the synchronized movement thereof into and out of the unloading area 12.

As disclosed in the above-referenced patents, during the finishing or tapping step, nut blanks 26 are disposed in an array of sockets 28 formed in a plurality of transfer segments 30. The transfer segments are guided along a stationary support plate 32 which underlies the transfer segments 30. The stationary support plate 32 is, in turn, supported by a second support plate 34.

In accordance herewith, as the transfer segment containing the tapped nut blanks is advanced to the unloading station, knock-out pins, being of greater diameter than the diameter of the bored hole in the finished blanks, lift the finished blanks such that the bottom surface 40 of the finished nut blanks 26 is coplanar with the top surface 42 of the transfer segment 30. The knock-out pins are synchronized through timed controls to lift the tapped blanks out of the transfer segment 30 and into device 10 which rakes or sweeps the finished blanks from the transfer segment at the unloading station. Raking or sweeping is achieved, as shown, by causing the finished blanks to abut against the arcuate wall 24, the short walls 20, 22 or those already swept blanks which are adjacent thereto.

It should be noted that the synchronization of movements or motion are achieved through timed controls well known to the skilled artisan.

With reference now to FIG. 5, there is depicted therein an alternate embodiment of the device or the present invention. In this embodiment the device, generally indicated at 110, includes a base plate member 112 and upstanding side walls 114 and 116 integrally formed therewith. A pair of upstanding short walls 118, 120 are integrally formed with the side walls and the base plate. The short walls are angularly disposed with respect to the side walls, as shown. An upstanding arcuate wall 122 interconnects the free ends of the short walls to define a substantially pentagonal raking device. The wall 122 is integrally formed with the base plate and the short walls.

An upstanding partition 124 traverses the interior of the device 110. The partition is disposed substantially medially between the ends of the sidewalls 114, 116 and is substantially perpendicular thereto and integrally formed therewith and the base plate.

The partition, thus, cooperates with the walls to form a first open-topped compartment 126 and a second open-walled, open-topped compartment 128. The compartmented device 110 facilitates the taking of the tapped finished blanks. The embodiment of the device works in the same manner heretofore described.

It should be noted that with regard to the pentagonal configuration accorded the device, this is dictated by the disposition of the sockets as well as the configuration of the shuttle plate. Thus, the invention contemplates other configurations.

Furthermore, it should be noted that although the invention has been discribed with respect to nut blanks, the invention is fully applicable in all instances where the sweeping of separate elements is desired or necessary.

I claim:

1. A device for sweeping separable elements from an unloading area comprising:

a. a base plate, b. a pair of upstanding side walls integrally formed with the base plate, c. a pair of upstanding short walls integrally formed with the side walls and the base plate, d. an arcuate wall integrally formed with the base plate and the short walls, and wherein the base plate is joined at each of the walls, the base plate and walls cooperating to define an open-topped, open-ended device.

2. The device of claim 1 wherein the short walls are angularly disposed with respect to the side walls.

3. The device of claim 1 which further includes an upstanding partition traversing the interior of the device, the partition being integrally formed with the base plate and the side walls and being substantially perpendicular to the side walls.

4. The device of claim 3 wherein the partition cooperates with the walls and the base plate to define a first open-topped compartment and a second open-topped, open-ended compartment.

5. The device of claim 1 wherein the device is open at one end and closed at the bottom by said base plate.

6. The device of claim 1 wherein the walls and the base plate define a space.

7. The device of claim 6 wherein the walls cooperate to confine the horizontal and longitudinal movement of said elements to said space.

8. The device of claim 6 wherein the height of said space is substantially equal to the height of said elements.

* * * * *